US011490736B1

(12) United States Patent
Liu et al.

(10) Patent No.: US 11,490,736 B1
(45) Date of Patent: Nov. 8, 2022

(54) RECLINER CHAIR, LOVE SEAT, OR SOFA WITH A T-CUSHIONED STRUCTURE BUT WITH INDEPENDENTLY MOVABLE SIDE STORAGE COMPARTMENTS FOR STORING VARIOUS ITEMS OR CUPHOLDERS

(71) Applicant: HHC CHANGZHOU CORPORATION, Changzhou (CN)

(72) Inventors: Chih Hsiung Liu, Benoni (ZA); Mei Jun Xu, Jiujiang (CN); Wu Qing Pan, Changzhou (CN)

(73) Assignee: HHC CHANGZHOU CORPORATION, Changzhou (CN)

( * ) Notice: Subject to any disclaimer, the term of this patent is extended or adjusted under 35 U.S.C. 154(b) by 0 days.

(21) Appl. No.: 17/402,522

(22) Filed: Aug. 14, 2021

(51) Int. Cl.
*A47C 7/62* (2006.01)
*A47C 1/02* (2006.01)

(52) U.S. Cl.
CPC ..... *A47C 7/624* (2018.08); *A47C 1/02* (2013.01)

(58) Field of Classification Search
CPC ..... A47C 7/622; A47C 7/624
USPC ..... 297/188.14–188.17, 188.01
See application file for complete search history.

(56) References Cited

U.S. PATENT DOCUMENTS 1,641,249 A * 9/1927 Blumental ..... A47C 7/70 296/37.9
2,518,381 A * 8/1950 Runkles ..... A47C 7/70 297/145
5,106,153 A * 4/1992 Durling ..... A47C 7/624 297/188.17
5,338,095 A * 8/1994 Laughlin ..... A47C 4/02 297/440.1
9,895,000 B2 * 2/2018 Hassman ..... A47C 7/54
10,681,987 B2 * 6/2020 Liu ..... A47C 31/008
2009/0152915 A1 * 6/2009 Krasna ..... A47C 7/624 297/217.3

FOREIGN PATENT DOCUMENTS

CN 209003305 6/2019

* cited by examiner

*Primary Examiner* — Robert Canfield
(74) *Attorney, Agent, or Firm* — Law Offices of Steven W. Weinrieb

(57) ABSTRACT

A furniture piece comprises a back section, a seat section, a leg section, a pair of laterally spaced arm sections, and a pair of front corner sections which are respectively disposed beneath the pair of laterally spaced arm sections and disposed upon opposite sides of said leg section. The pair of front corner sections, the leg section, and the seat section comprise cushioned sections such that collectively, the pair of front corner sections, the leg section, and the seat section define a T-cushioned structure for the furniture piece. In addition, the pair of front corner sections are movable in forward and backward directions and have storage compartments defined therein such that when either one of said pair of front corner sections is moved forwardly from a retracted or closed position, to an extended or open position, the storage compartment is rendered accessible such that items can be inserted into or removed from the storage compartment.

9 Claims, 8 Drawing Sheets

RECLINER CHAIR, LOVE SEAT, OR SOFA WITH A T-CUSHIONED STRUCTURE BUT WITH INDEPENDENTLY MOVABLE SIDE STORAGE COMPARTMENTS FOR STORING VARIOUS ITEMS OR CUPHOLDERS

FIELD OF THE INVENTION

The present invention relates generally to furniture pieces, and more particularly to a recliner chair, love seat, or sofa which appears to have a substantially T-cushion appearance, but wherein, in reality, the vertically oriented front side sections of the recliner chair, love seat, or sofa, disposed upon opposite sides of the centrally located leg and footrest cushions of the recliner chair, love seat, or sofa, have exterior portions which appear to be cushions but are actually cushioned facia behind which are located storage compartments for storing various items, or which can alternatively house cupholders for the convenience of the person or persons sitting upon the recliner chair, love seat, or sofa. These front side sections of the recliner chair, love seat, or sofa are independently movable, between open and closed positions, with respect to the centrally located leg and footrest sections of the chair, love seat, or sofa which are movable between fully lowered positions at which the leg and footrest sections of the chair, love seat, or sofa are disposed within a vertical plane, and fully raised positions at which the leg and footrest sections of the chair, love seat, or sofa are disposed within a substantially horizontal plane. The vertically oriented, independently movable front side sections of the chair, love seat, or sofa, comprising the storage components, can be opened or closed manually, or by conventional powered actuators, and in a similar manner, the leg and footrest sections of the chair, love seat, or sofa can likewise be moved between their lowered and raised positions either manually or by conventional powered actuators.

BACKGROUND OF THE INVENTION

Conventional recliner chairs, love seats, and sofas, such as, for example, the recliner chair disclosed and generally indicated by the reference character 100 within FIG. 1, all have reclining back sections 102, as well as seat 103, leg 104, and foot sections 106 wherein the leg and foot sections 104, 106 are movable between retracted or lowered, and extended or elevated, positions so as to effectively move the person or persons, sitting in the recliner chair, love seat or sofa, from an upright, seated position, to a substantially supine position when the back section 102 is moved to its reclined position and when the leg and foot sections 104,106 are moved to their extended or elevated positions, whereby the person or persons can be disposed within a relaxed state. More particularly, it can be further appreciated that the back, leg, and foot sections 102,104,106 all come with or comprise cushions which are designed to fit the dimensions of the base, not shown, upon which the recliner chair, love seat, or sofa 100 is mounted and supported. It can be further appreciated that the cushions of the seat and leg sections 103,104 have a substantially square or rectangular configuration, or more accurately, configurations which are substantially that of a cube or a rectangular parallelepiped. Still yet further, the recliner chair, love seat, or sofa 100 comprises laterally spaced, oppositely disposed arm portions 108,110 and laterally spaced, oppositely disposed vertical side sections 112,114 which are respectively disposed beneath the laterally spaced, oppositely disposed arm sections 108,110.

In addition to the conventional recliner chair, love seat, or sofa 100 as illustrated within FIG. 1, comprising the cushioned seat and leg sections 103,104, wherein the cushions of such seat and leg sections 103,104 have substantially square or rectangular configurations, or more accurately, comprise configurations which are substantially that of a cube or a rectangular parallelepiped, other conventional recliner chairs, love seats, or sofas, such as those illustrated within FIGS. 2-4, and generally indicated by the reference characters 200,300,400 comprise cushioned seat, leg, and foot sections 203,204, 206, 303,304,306, and 403,404,406 which effectively define T-cushions wherein the seat cushions 203,303,403, taken together with the leg and foot sections 204, 206,304,306,404,406 effectively define a cushioned structure which has a substantially T-shaped configuration. More particularly, the primary structural difference between the conventional recliner chair, love seat, or sofa 100 as disclosed within FIG. 1, and the T-cushioned recliner chairs, love seats, or sofas as disclosed within FIGS. 2-4, is immediately apparent in that, as can be appreciated from FIG. 1, when the leg and foot sections 104,106 are disposed at their retracted or lowered positions, as they are illustrated within FIG. 1, the front surface portions of the leg and foot sections 104,106 of the recliner chair, love seat, or sofa 100 are disposed within a vertical plane which is coplanar with the front surface portions of the laterally spaced, oppositely disposed vertical side sections 112,114 of the recliner chair, love seat, or sofa 100 as well as the forwardmost end portions of the laterally spaced, oppositely disposed arm sections 108,110 of the recliner chair, love seat, or sofa 100.

To the contrary, as can be readily appreciated from FIGS. 2-4, the seat sections 203,303,403 have effectively been extended in the forward direction such that the front surface portions of the leg and foot sections 204,206, 304,306,404, 406 are now disposed within a vertical plane which is disposed in front of the vertical plane within which the front surface portions of the laterally spaced, oppositely disposed vertical side sections 212,214,312,314,412,414 of the recliner chairs, love seats, or sofas 200, 300,400, as well as the forwardmost end portions of the laterally spaced, oppositely disposed arm sections 208,210, 308,310,408,410 of the recliner chairs, love seats, or sofas 200,300,400 are disposed. In addition, the T-cushions of the recliner chairs, love seats, or sofas 200,300,400 also comprise additional, front or forwardly located, laterally spaced side cushions 216,218, 316,318,416,418 which are disposed upon opposite sides of the centrally located leg sections 204,304,404 of the recliner chairs, love seats, or sofas 200,300,400 and which are fixedly secured to the leg and foot sections 204,206,304, 306,404,406 of the recliner chairs, love seats, or sofas 200,300,400 so as to be movable with the leg and foot sections 204,206,304,306,404,406 of the recliner chairs, love seats, or sofas 200,300,400 when the leg and foot sections 204,206,304,306,404,406 of the recliner chairs, love seats, or sofas 200,300,400 are moved between their retracted or lowered positions, and their extended or elevated positions. Still further, it is noted that as a result of this particular structure comprising the T-cushioned recliner chairs, love seats, or sofas 200,300,400, the arm sections 208,210,308,310,408,410 of the recliner chairs, love seats, or sofas 200,300,400 are effectively set back with respect to the front surface portions of the centrally located leg sections 204,304,404 of the recliner chairs, love seats, or sofas 200,300,400, as well as the front surface portions of the laterally spaced, oppositely disposed side cushions 216,218, 316, 318,416,418 of the recliner chairs, love seats, or sofas 200,300,400. Lastly, it is noted that as a result of this particular structure comprising the T-cushioned recliner chairs, love seats, or sofas 200,300,400, the T-shaped cushioning of the recliner chairs, love seats, or sofas 200,300,400 appear to wrap themselves around the front end portions of the T-cushioned recliner chairs, love seats, or sofas 200,300, 400. This wrap-around structure effectively provides the T-cushioned recliner chairs, love seats, or sofas 200,300,400 with a more luxurious, aesthetically pleasing, or elegant-looking recliner chair, love seat, or sofa. Hence, such T-cushioned recliner chairs, love seats, or sofas are becoming quite popular with interior decorators and consumers desiring to upgrade their home or office furnishings.

When consumers are seated within the aforenoted T-cushioned recliner chairs, love seats, or sofas 200,300,400, they are often either reading a book, a newspaper, or a magazine, or watching TV, and therefore the consumers usually want or need access to their remote control devices in order to select particular programs to be watched, to switch TV channels when a different program is to be watched, or to the book, magazine, or newspaper that they want to read. In a similar manner, consumers watching TV, or reading, often desire to eat and/or drink a beverage. Therefore, it is apparent that one of the practical problems with the aforenoted T-cushioned recliner chairs, love seats, or sofas 200,300,400 is that there is no provision for holding or storing the various aforenoted implements, that is, the remote control for the TV, the book, magazine, or newspaper, or still further, a cupholder for a person's beverage, within the aforenoted T-cushioned recliner chairs, love seats, or sofas 200,300,400.

A need therefore exists in the art for a new and improved T-cushioned recliner chair, love seat, or sofa which resolves the aforenoted problem. Another need exists in the art for a new and improved T-cushioned recliner chair, love seat, or sofa which resolves the aforenoted problem while simultaneously incorporating a storage space within the aforenoted T-cushioned recliner chairs, love seats, or sofas. An additional need exists in the art for a new and improved T-cushioned recliner chair, love seat, or sofa which resolves the aforenoted problem while simultaneously incorporating a storage space within the aforenoted T-cushioned recliner chairs, love seats, or sofas without adversely affecting the luxurious, aesthetically pleasing, or elegant-looking appearance of the recliner chair, love seat, or sofa. A further need exists in the art for a new and improved T-cushioned recliner chair, love seat, or sofa which resolves the aforenoted problem, while simultaneously incorporating a storage space within the aforenoted T-cushioned recliner chairs, love seats, or sofas without adversely affecting the luxurious, aesthetically pleasing, or elegant-looking appearance of the recliner chair, love seat, or sofa, such that various items, such as, for example, a TV remote control device, or a cup holder for accommodating a cup within which there is a beverage, may be incorporated within the T-cushioned recliner chair, love seat, or sofa.

OVERALL OBJECTIVES OF THE INVENTION

Accordingly, an overall objective of the present invention is to provide a new and improved T-cushioned recliner chair, love seat, or sofa which resolves the aforenoted problem. Another overall objective of the present invention is to provide a new and improved T-cushioned recliner chair, love seat, or sofa which resolves the aforenoted problem while simultaneously incorporating a storage space within the aforenoted T-cushioned recliner chairs, love seats, or sofas. An additional overall objective of the present invention is to provide a new and improved T-cushioned recliner chair, love seat, or sofa which resolves the aforenoted problem while simultaneously incorporating a storage space within the aforenoted T-cushioned recliner chairs, love seats, or sofas without adversely affecting the luxurious, aesthetically pleasing, or elegant-looking appearance of the recliner chair, love seat, or sofa. A further overall objective of the present invention is to provide a new and improved T-cushioned recliner chair, love seat, or sofa which resolves the aforenoted problem, while simultaneously incorporating a storage space within the aforenoted T-cushioned recliner chairs, love seats, or sofas without adversely affecting the luxurious, aesthetically pleasing, or elegant-looking appearance of the recliner chair, love seat, or sofa, such that various items, such as, for example, a TV remote control device, or a cup holder for accommodating a cup within which there is a beverage, may be incorporated within the T-cushioned recliner chair, love seat, or sofa.

SUMMARY OF THE INVENTION

In accordance with the principles and teachings of the present invention, there is provided a new and improved recliner chair, love seat, or sofa having a T-cushioned structure but with independently movable storage compartments, disposed beneath the laterally spaced, oppositely disposed side arm sections of the recliner chair, love seat, or sofa, for storing various items or cupholders. More particularly, in lieu of the additional, front or forwardly located, laterally spaced side cushions which are disposed upon opposite sides of the centrally located leg sections of the recliner chairs, love seats, or sofas and which are fixedly secured to the leg and foot sections of the recliner chairs, love seats, or sofas so as to be movable with the leg and foot sections of the recliner chairs, love seats, or sofas when the leg and foot sections of the recliner chairs, love seats, or sofas are moved between their retracted or lowered positions, and their extended or elevated positions, in accordance with the principles and teachings of the present invention, the aforenoted additional, front or forwardly located, laterally spaced side cushions which are disposed upon opposite sides of the centrally located leg sections of the recliner chairs, love seats, or sofas have effectively been replaced by a pair of front or forwardly located, laterally spaced front corner sections which are separate and independent of the movable leg and foot sections of the recliner chair, love seat, or sofa.

All of the external surface portions of the pair of front or forwardly located, laterally spaced front corner sections of, for example, the recliner chair, are cushioned so as to effectively match or blend in with the remaining structural components comprising the T-cushioned structure, such as, for example, the back, seat, arm, vertical side, leg, and foot sections of the recliner chair, however, the front corner sections of the T-cushioned chair of the present invention have substantially the same lateral width dimension as those of the arm sections of the recliner, as well as the same lateral width dimensions as those of the vertical side sections of the T-cushioned chair which are disposed beneath the arm sections of the chair. In addition, such front corner sections of the recliner chair are linearly movable in forward and rearward directions, or alternatively, are pivotally movable in an arcuate manner around a lower, horizontally oriented axis so as to be movable between retracted or closed positions and extended or open positions. Still further, the front corner sections of the recliner chair define storage compartments which are located immediately behind the front cushioned surface portions of the front corner sections. When the storage compartments are disposed at their retracted or closed positions, the new and improved T-cushioned recliner chair, sofa, or love seat of the present invention will visually appear to be similar to conventional T-cushioned recliner chairs, love seats, or sofas, whereas when the storage compartments are disposed at their extended or open positions, the storage compartments will be exposed so as to not only be capable of housing various items, such as, for example, a TV remote control device, a book, a magazine, a newspaper, or the like, or a cupholder for holding a cup containing a beverage, but for permitting access to such items by the occupant of the recliner chair.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
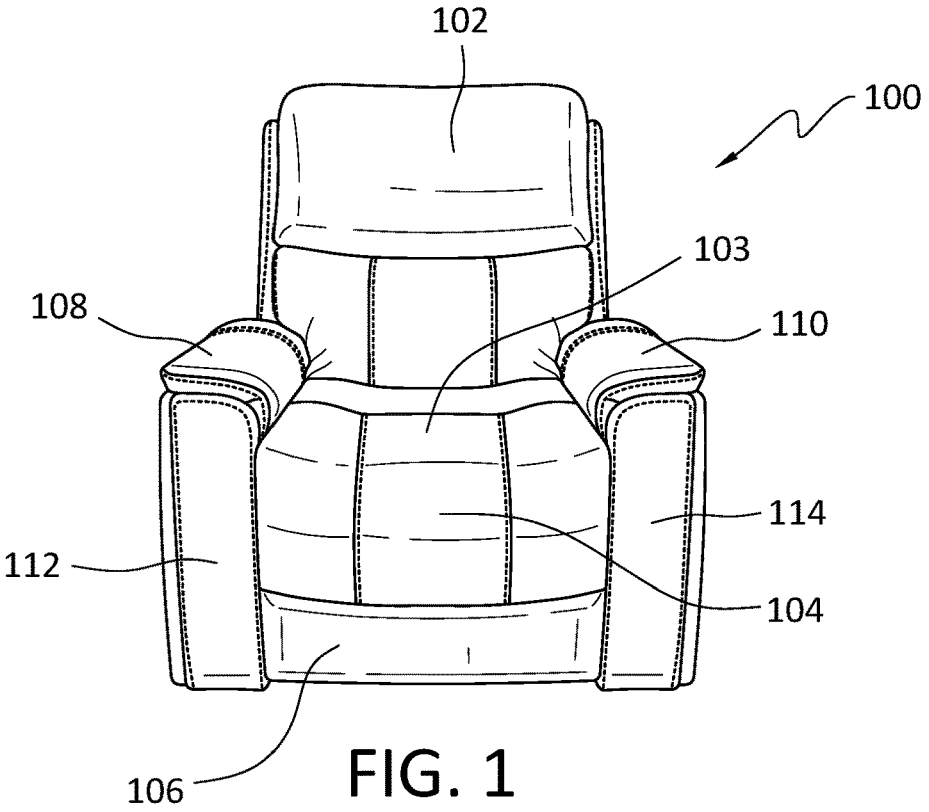
FIG. 1 (PRIOR ART)
FIG. 1 is a front elevational view of a first embodiment of a conventional recliner chair and has been labelled PRIOR ART.
Figure 2:
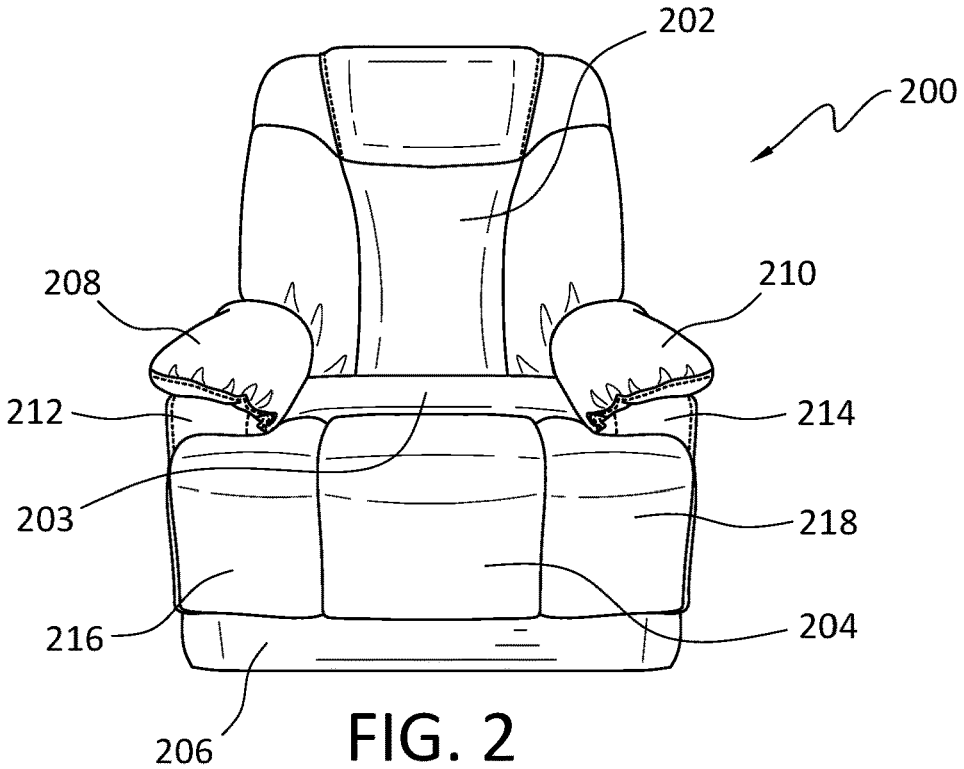
FIG. 2 (PRIOR ART)
FIG. 2 is a front elevational view of a second embodiment of a conventional recliner chair which has a T-cushioned structure wherein the leg and foot sections of the chair are disposed at their retracted or closed positions, and wherein the chair has also been labelled PRIOR ART.
Figure 3:
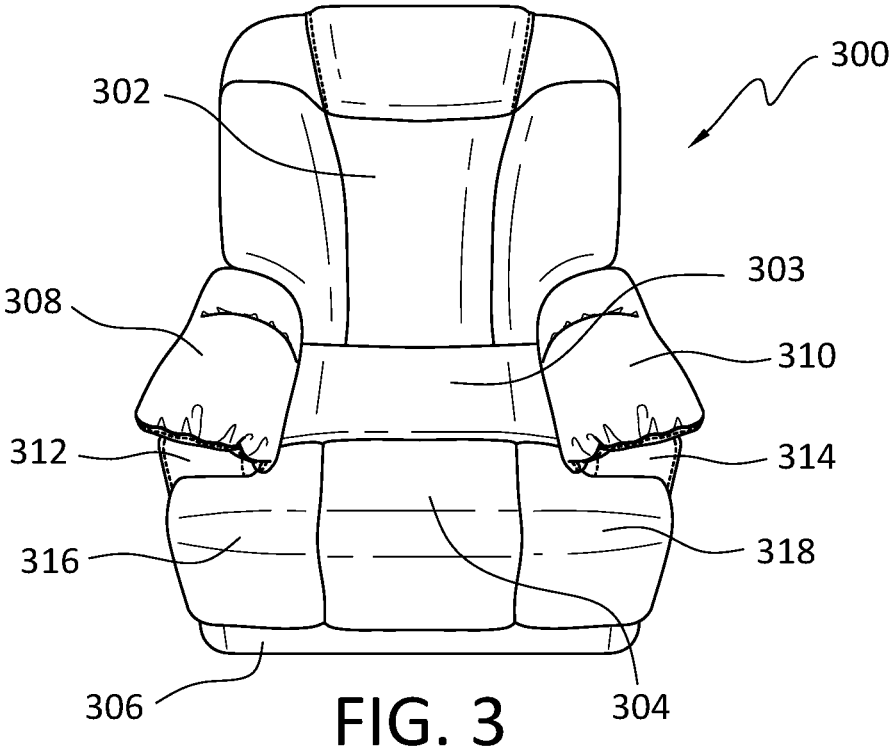
FIG. 3 (PRIOR ART)
FIG. 3 is a front elevational view of a third embodiment of a conventional recliner chair which is similar to that of the second embodiment of a conventional recliner chair having the T-cushioned structure wherein the leg and foot sections of the chair are likewise illustrated at their retracted or closed positions, although some of the structural components of the third embodiment T-cushioned chair appear to be somewhat different from the corresponding structures of the second embodiment of the conventional T-cushioned chair as illustrated within FIG. 2, and wherein the chair of FIG. 3 has likewise been labelled PRIOR ART.
Figure 4:
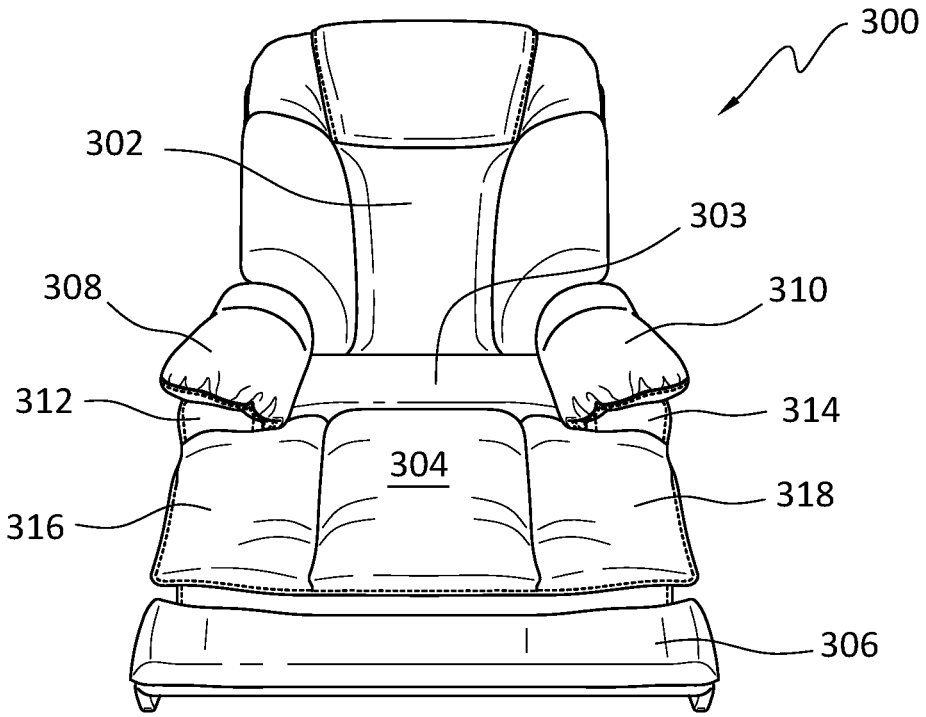
FIG. 4 (PRIOR ART)
FIG. 4 is a front elevational view of the third embodiment of the recliner chair as illustrated within FIG. 3 showing, however, the leg and foot sections of the chair disposed at their extended or open positions.
Figure 5:
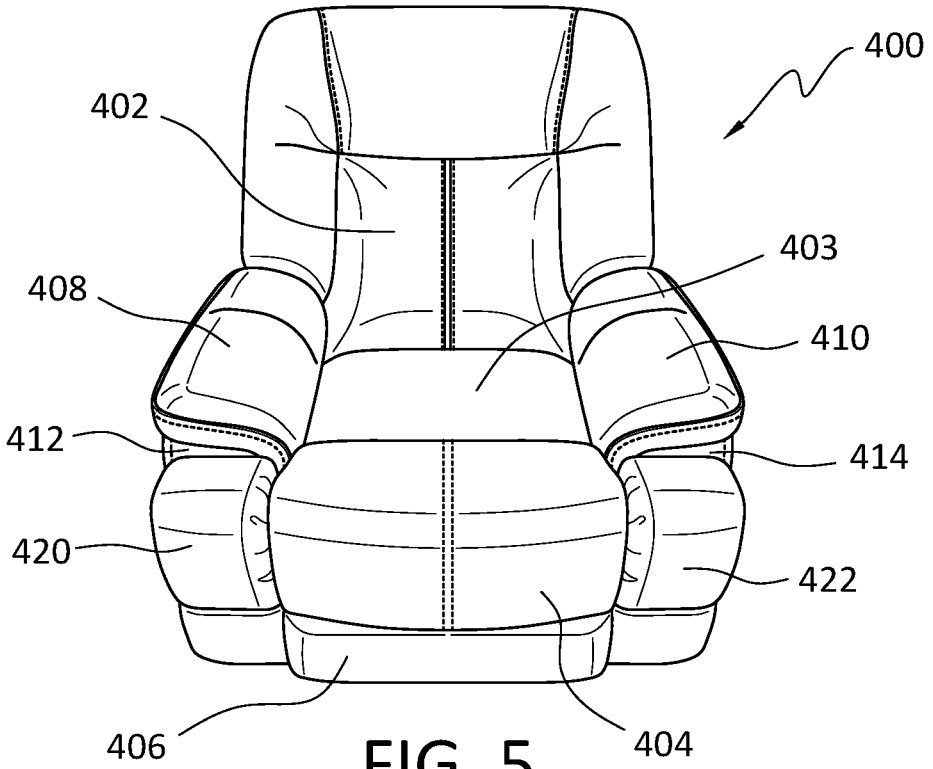
FIG. 5 is a front elevational view of a new and improved T-cushioned recliner chair, as constructed in accordance with the principles and teachings of the present invention, wherein front corner sections of the T-cushioned recliner chair comprise movable storage compartments which are separate and independent from the leg and foot sections of the chair and which may be moved linearly in a forward and backward manner, or alternatively, pivotally moved around a lower horizontally oriented axis, between retracted or closed positions, and extended or open positions, so as to effectively define internal storage compartments within such front corner sections of the T-cushioned recliner chair, or alternatively, provide the front corner sections of the T-cushioned recliner chair with cupholders for use by the occupant of the chair.

With reference now being made to FIGS. 5-8 and 10, and in accordance with the principles and teachings of the present invention, a new and improved recliner chair, love seat, or sofa, having a T-cushioned structure but with independently movable side storage compartments for storing various items or cupholders, is disclosed and is generally indicated by the reference number 400. For simplicity, while the principles and teachings of the present can be applied to recliner chairs, love seats, and sofas, for disclosure purposes, the disclosure will be limited to recliner chairs, but will, of course, be applicable to love seats and sofas. It is also to be noted that those sections of the new and improved T-cushioned recliner chair 400 that correspond to sections of conventional T-cushioned recliner chairs, as have been illustrated within FIGS. 2 and 3, will be denoted by corresponding reference characters, however, the reference characters will be within the 400 series. In addition, the disclosure will concentrate upon the new and improved features characteristic of the T-cushioned chair 400 as compared with conventional T-cushioned chairs such as T-cushioned chairs 200 and 300. Accordingly, it can be appreciated that in accordance with the principles and teachings of the present invention, the primary feature characteristic of the present invention resides in the fact that in lieu of the additional, front or forwardly located, laterally spaced side cushions

216,218,316,318 which are disposed upon opposite sides of the centrally located leg sections 204,304 of the conventional T-shaped recliner chairs 200,300, and which are fixedly secured to the leg and foot sections 204,206,304,306 of the conventional T-cushioned recliner chairs 200,300 so as to be movable with the leg and foot sections 204,206, 304,306 of the recliner chairs 200,300, when the leg and foot sections 204,206,304,306 of the recliner chairs 200,300 are moved between their retracted or lowered positions, and their extended or elevated positions, the aforenoted additional, front or forwardly located, laterally spaced side cushions 216,218,316,318, which are disposed upon opposite sides of the centrally located leg sections 204,304 of the recliner chairs 200,300, have effectively been replaced by a pair of forwardly located, laterally spaced front corner sections 420,422 which are separate and independent from the movable leg and foot sections 404,406 of the recliner chair 400.

It is to be noted that all of the external surface portions of the pair of forwardly located, laterally spaced front corner sections 420,422 of the recliner chair 400 are cushioned so as to effectively match or blend in with the remaining structural components comprising the T-cushioned structure, such as, for example, the back section 402, the seat section 403, the arm sections 408,410, the vertical side sections 412,414, and the leg and foot sections 404,406 of the recliner chair 400, however, unlike the additional, front or forwardly located, laterally spaced side cushions 216,218, 316,318 of the recliner chairs 200,300 which overlapped or covered the front surface portions of the vertical side wall sections 212,214,312,314 of the recliner chairs 200,300, the front corner sections 420,422 of the T-cushioned chair 400 of the present invention have substantially the same lateral width dimension as those of the arm sections 408,410 of the recliner chair 400, as well as the same lateral width dimensions as those of the vertical side sections 412,414 of the T-cushioned chair 400, and are disposed beneath the arm sections 408,410 of the chair. In addition, such front corner sections 420,422 of the recliner chair 400 are Linearly movable in forward and rearward directions, as schematically denoted by the double arrowhead x in FIG. 8, or alternatively, are pivotally movable in an arcuate manner, as schematically noted by the double arrowhead a around a lower, horizontally oriented axis, as denoted by the axis Y in FIG. 7, so as to be movable between retracted or closed positions and extended or open positions.

Figure 7:
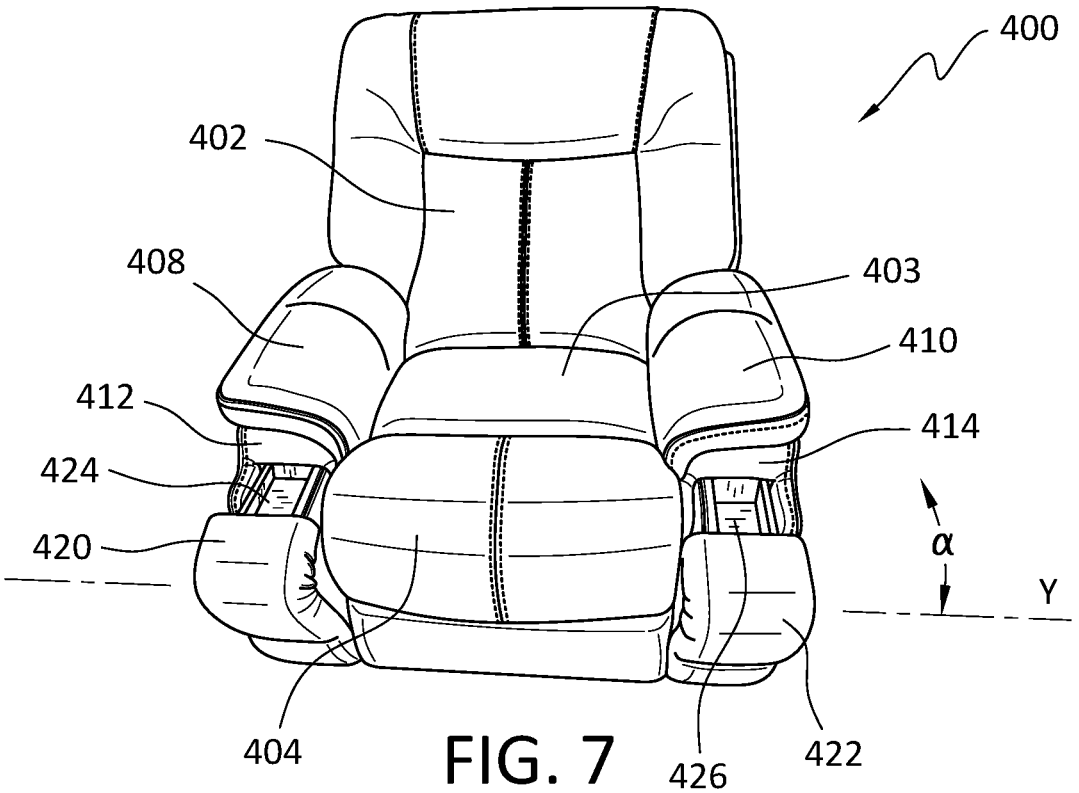
FIG. 7 is a front elevational view of the new and improved T-cushioned recliner chair, as illustrated within FIGS. 5 and 6, wherein the front corner sections of the new and improved T-cushioned chair have been moved to their extended or open positions, while the leg and foot sections of the recliner chair have been maintained at their retracted or closed positions, such that the opened front corner sections of the recliner chair reveal storage compartments which are integrally defined within the front corner sections of the new and improved T-cushioned chair and which are located directly behind the cushioned, front surface portions of the front corner sections of the recliner chair.
Figure 6:
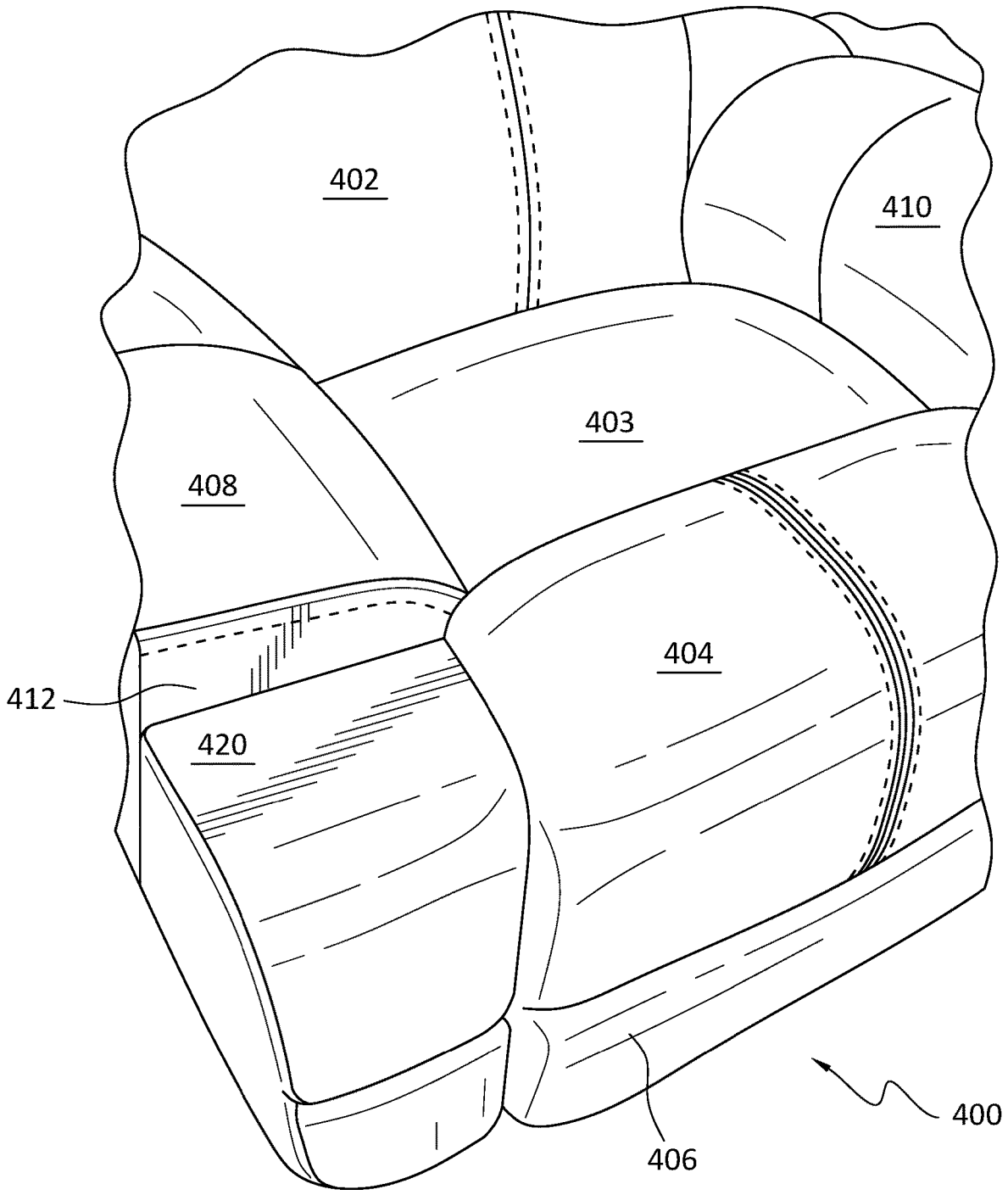
FIG. 6 is an enlarged detailed view of the left front corner section of the new and improved recliner chair as illustrated within FIG. 5 wherein the movable front corner section of the chair is disclosed at its retracted or closed position.
Figure 8:
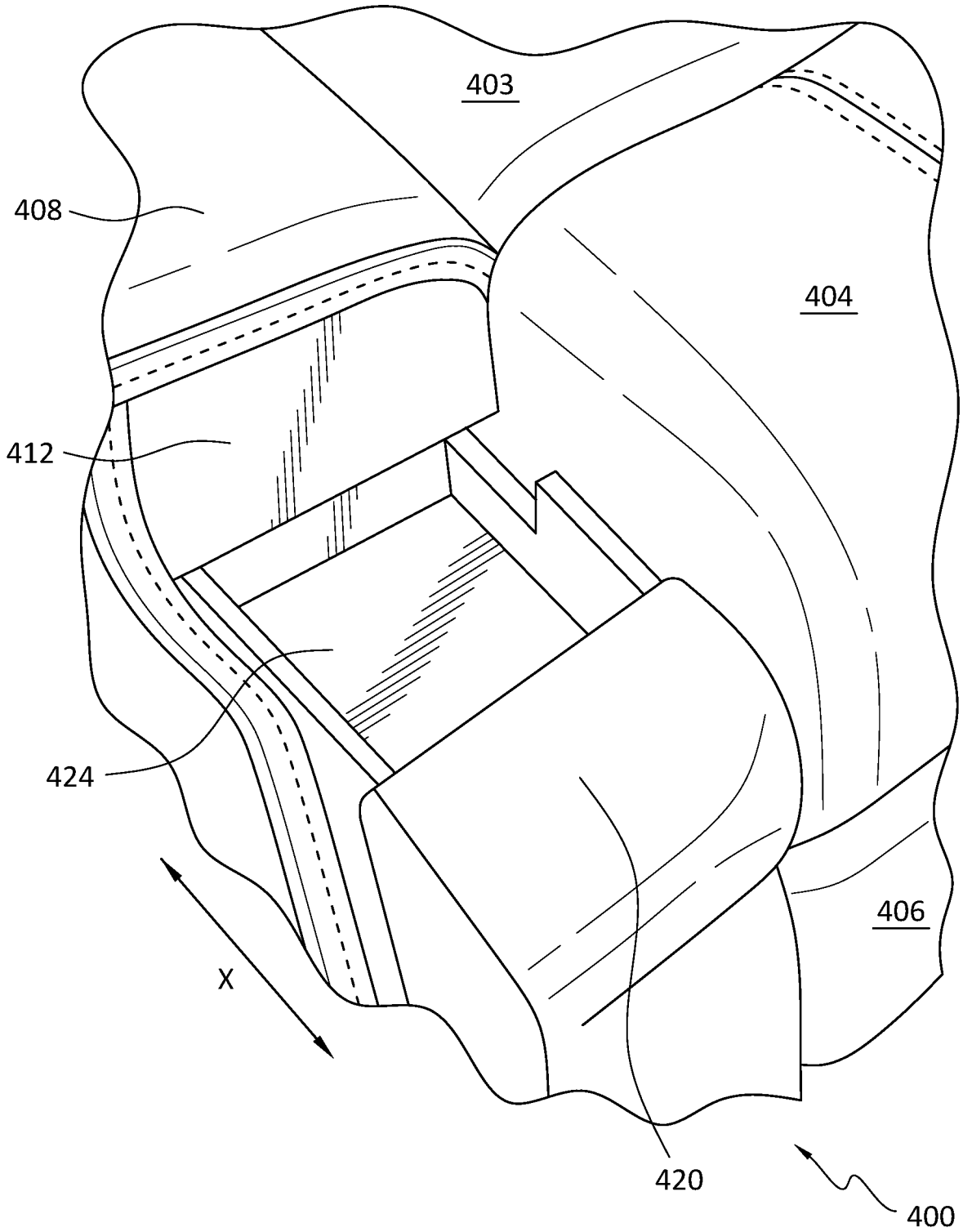
FIG. 8 is an enlarged detailed view of one front corner section of the new and improved T-cushioned recliner chair, as illustrated within FIGS. 5-7, clearly illustrating one of the storage compartments defined behind one of the front corner sections of the chair, as well as the fact that the illustrated front corner section of the chair has been moved to its open position while the foot section of the chair is disposed at a position between its fully open or extended position and its fully closed or retracted position.
Figure 11:
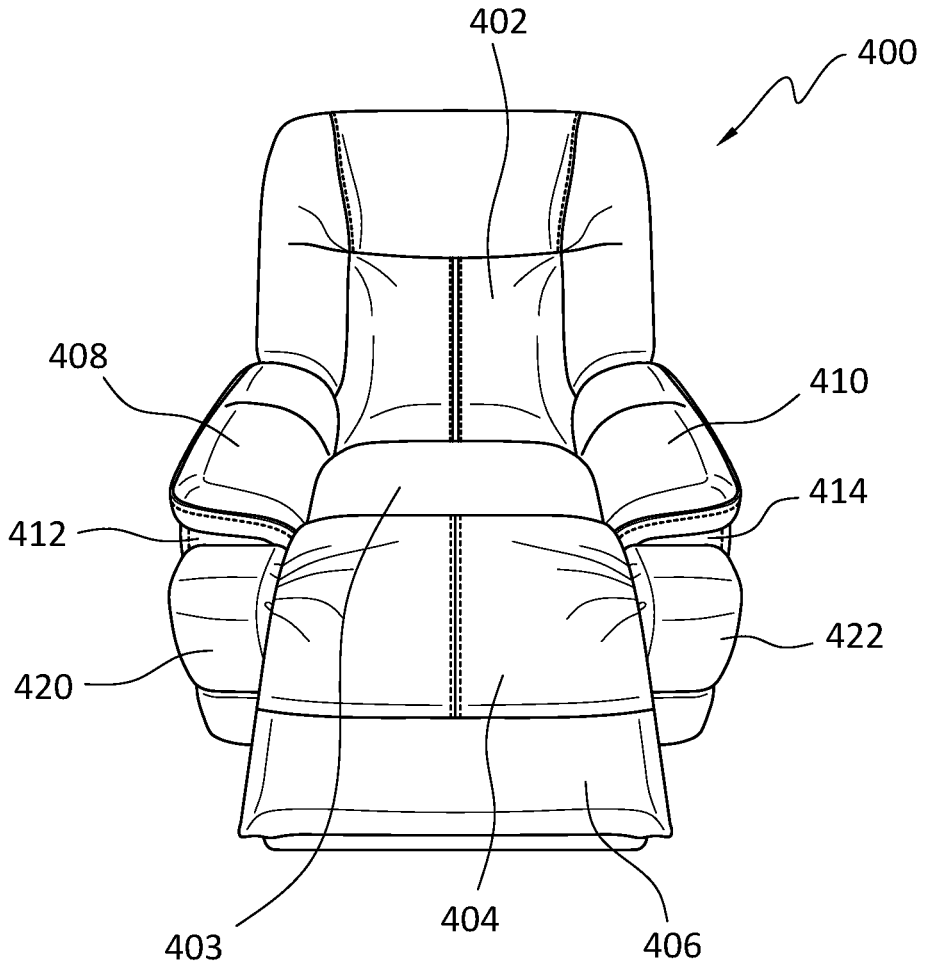
FIG. 11 is a front elevational view, similar to those of FIGS. 5 and 7, showing the leg and foot sections of the T-cushioned recliner chair of the present invention when the leg and foot sections have been moved to their extended positions while the storage compartments are disposed at their closed positions

Continuing further, and with reference being made to FIGS. 7 and 8, it can be appreciated that when the front corner sections 420,422 of the recliner chair 400 are moved forwardly to their extended or open positions, only front corner section 420 being visible in FIG. 8, such forward movements effectively uncover storage compartments 424, 426 which are defined within the front corner sections 420,422 and which are located immediately behind the front cushioned surface portions of the front corner sections 420,422. When the front corner sections 420,422 of the recliner chair 400 are disposed at their extended or open positions, the storage compartments will be exposed such that various items, such as, for example, a TV remote control device, a book, a magazine, a newspaper, or the like, having been stored therein, are rendered accessible to, for example, an occupant of the recliner chair 400. Conversely, when the front corner sections 420,422 are moved back to their retracted or closed positions, the storage compartments 424,426 will be render inaccessible whereby the new and improved T-cushioned recliner chair 400 of the present invention will visually appear to be similar to the conventional T-cushioned recliner chairs 200,300. It is of course also to be noted that, as is conventional with any recliner chair, the leg and foot sections 404,406 are actuated between their raised or elevated or extended positions, and their lowered or retracted positions by means of a suitable linkage mechanism 428, which can be seen in FIG. 10, and suitable actuator, not shown. As shown in FIG. 11, as has been noted hereinbefore, the leg and foot sections 404,406 of the chair 400 can be moved independently of the movement of the front corner sections 420,422, and vice versa, wherein it is seen that the leg and foot sections 404*f*,406 have been moved to their extended positions while the front corner sections 420,422, within which the storage compartments are disposed, are disposed at their retracted or closed positions.

Figure 9:
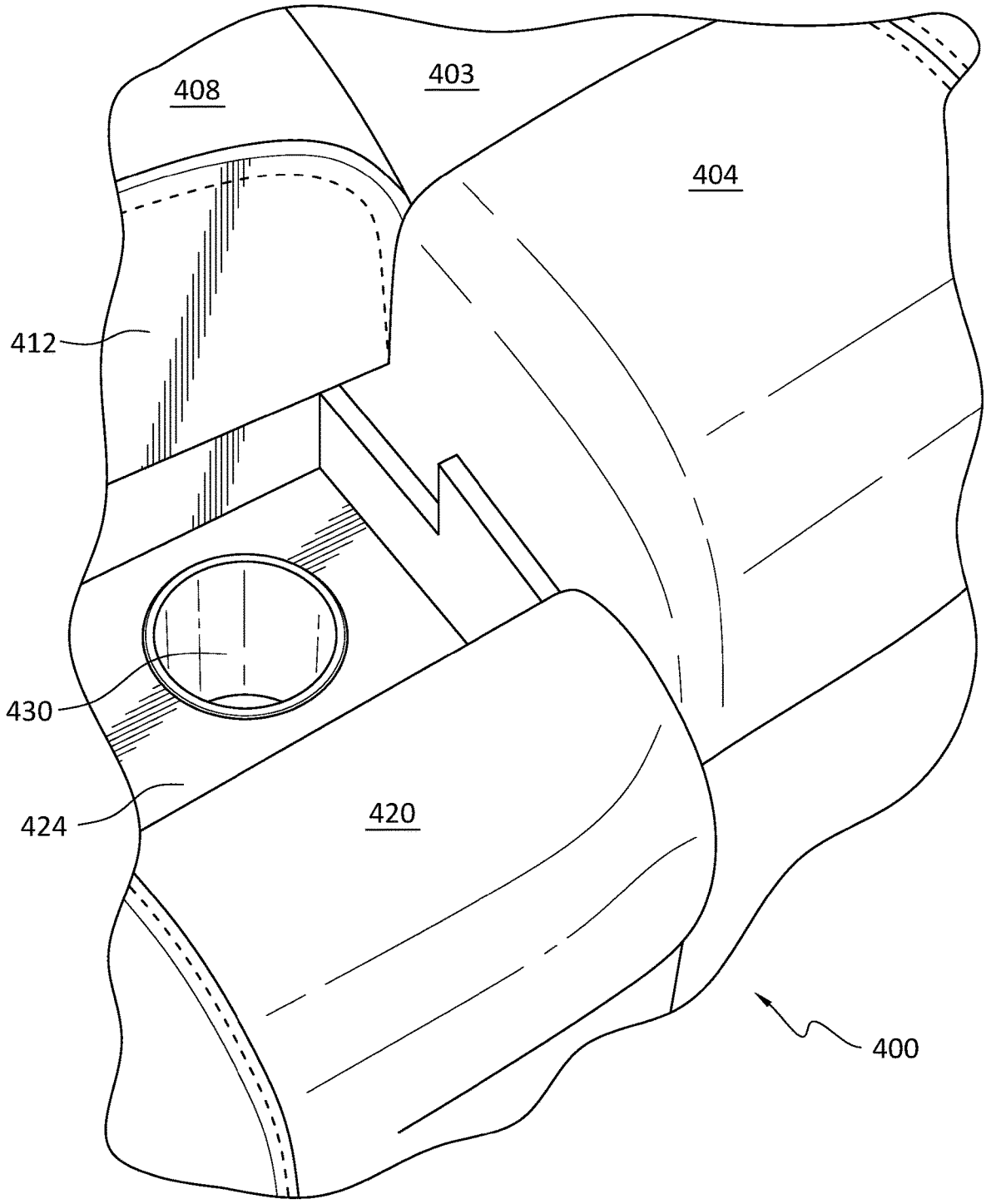
FIG. 9 is an enlarged detailed view of one of the front corner sections of the new and improved T-cushioned recliner chair, as illustrated within FIGS. 5-7, and similar to FIG. 8, schematically showing, however, the storage compartment containing a cupholder.
Figure 10:
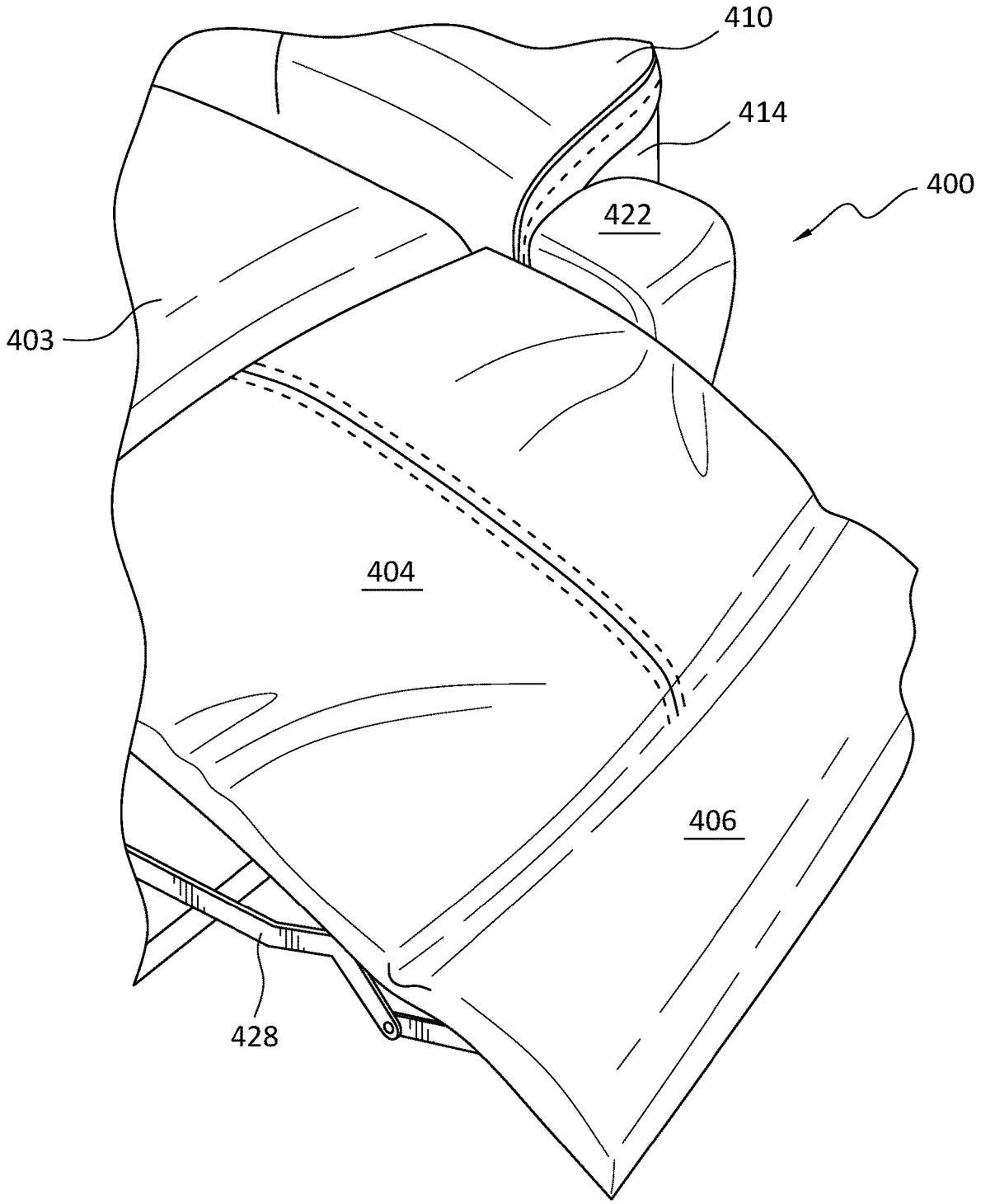
FIG. 10 is a left side, front perspective view of the recliner chair as illustrated within FIGS. 5-9, wherein the leg and foot sections of the recliner chair have been moved to their extended or open positions by means of suitable linkage mechanisms operatively connected to a suitable actuator, not shown, which may be either manual or powered.

It is lastly seen in FIG. 9 that the storage compartments [0024] 424,426, only storage compartment 424 being shown in FIG. 9, can have a cupholder 430 provided therein. The cupholders 430 can be provided in addition to the storage spaces defined within the storage compartments 424,426 whereby, for example, the storage compartments 424,426 can store the various items noted hereinbefore, and once such items are removed from the storage compartments 424,426, a cup, glass, mug, or the like, containing a suitable beverage, may be inserted into the cupholder 430 for the convenience of the occupant of the recliner chair 400.

Obviously, many variations and modifications of the present invention are possible in light of the above teachings. For example, such storage compartments as have been disclosed herein can also be incorporated within furniture pieces that do not recline. In addition, the compartments can also be used to house or contain other conveniences, such as, for example, wireless charging adaptors, USB or Type-C charging ports, LED lighting, and the like. It is therefore to be understood that within the scope of the appended claims, the present invention may be practiced otherwise than as specifically described herein.

What is claimed as new and desired to be protected by Letters Patent, is:

1. A furniture piece, comprising:

a back section;

a seat section;

a leg section;

a pair of laterally spaced side wall sections having a predetermined width dimension;

a pair of laterally spaced arm sections disposed atop said pair of laterally spaced side wall sections; and a pair of laterally spaced front corner sections respectively disposed beneath said pair of laterally spaced arm sections, disposed in front of said pair of laterally spaced side wall sections, and disposed upon opposite sides of said leg section, wherein said pair of front corner sections, said leg section, and said seat section comprise cushioned sections such that collectively, said pair of front corner sections, said leg section, and said seat section define a T-cushioned structure for said furniture piece; and wherein said pair of front corner sections are movable in forward and backward directions and have storage compartments defined therein such that when either one of said pair of front corner sections is moved forwardly from a retracted or closed position, to an extended or open position, said storage compartment defined within said one of said pair of front corner sections will be rendered accessible such that items can be inserted into or removed from said storage compartment.

2. The furniture piece as set forth in claim 1, wherein:

said furniture piece is selected from the group comprising a chair, a love seat, and a sofa.

3. The furniture piece as set forth in claim 1, wherein:

said furniture piece comprises a chair.

4. The furniture piece as set forth in claim 3, wherein:

said chair comprises a recliner chair.

5. The furniture piece as set forth in claim 4, wherein:

said back section and said leg section are respectively movable between reclined and upright positions, and between extended and retracted positions; and said pair of front corner sections are movable between said extended and retracted positions independent of said movement of said back section between said reclined and upright positions, and said movement of said leg sections between said extended and retracted positions.

6. The furniture piece as set forth in claim 1, wherein:

said pair of front corner sections, movable in said forward and backward directions, are linearly movable between said retracted or closed position and said extended or open position.

7. The furniture piece as set forth in claim 1, wherein:

said pair of front corner sections, movable in said forward and backward directions, are pivotally movable, between said retracted or closed position and said extended or open position, around a horizontally oriented axis.

8. The furniture piece as set forth in claim 1, wherein:

said storage compartments, defined within said front corner sections of said furniture piece, contain cupholders for holding a beverage container.

9. The furniture piece as set forth in claim 1, wherein:

said pair of front corner sections have predetermined width dimensions which are substantially the same as said predetermined width dimensions of said pair of laterally space side wall portions of said furniture piece.

* * * * *